US010767875B2

(12) United States Patent
Boucher et al.

(10) Patent No.: US 10,767,875 B2
(45) Date of Patent: Sep. 8, 2020

(54) HUMIDITY CONTROL UNIT AND METHOD HAVING BYPASS FOR PROCESS AIR

(71) Applicant: Munters Corporation, Selma, TX (US)

(72) Inventors: Michael Boucher, Lexington, VA (US); Paul Dinnage, New Braunfels, TX (US); Rafael Neuwald, Lexington, VA (US)

(73) Assignee: Munters Corporation, Selma, TX (US)

( * ) Notice: Subject to any disclaimer, the term of this patent is extended or adjusted under 35 U.S.C. 154(b) by 153 days.

(21) Appl. No.: 15/823,700

(22) Filed: Nov. 28, 2017

(65) Prior Publication Data

US 2019/0162431 A1 May 30, 2019

(51) Int. Cl.
*F24F 3/14* (2006.01)

(52) U.S. Cl.
CPC ..... *F24F 3/1423* (2013.01); *F24F 3/1429* (2013.01); *F24F 2003/144* (2013.01); *F24F 2003/1464* (2013.01)

(58) Field of Classification Search
CPC .. F24F 3/1423; F24F 3/1429; F24F 2003/144; F24F 2033/1464; F24F 2012/007; F24F 12/03; Y02B 30/42
See application file for complete search history.

(56) References Cited

U.S. PATENT DOCUMENTS

| | | | | |
|---|---|---|---|---|
| 9,739,497 | B2 * | 8/2017 | Dobbs | F24F 3/1405 |
| 9,920,960 | B2 * | 3/2018 | Gerber | F25B 13/00 |
| 2004/0000152 | A1 * | 1/2004 | Fischer | F24F 3/1423 62/94 |
| 2005/0050906 | A1 * | 3/2005 | Dinnage | F24F 3/1405 62/94 |
| 2011/0079024 | A1 * | 4/2011 | Hakbijl | F24F 5/0035 62/56 |
| 2013/0248147 | A1 * | 9/2013 | Wintemute | F28F 27/02 165/96 |

* cited by examiner

*Primary Examiner* — Elizabeth J Martin
(74) *Attorney, Agent, or Firm* — Venable LLP

(57) ABSTRACT

In conditioning air for an enclosure, a first ambient airstream is cooled by the cooling coil of a refrigerant cooling system to reduce its temperature and humidity content. The thus cooled and dehumidified air is then passed through a segment of a rotating desiccant wheel to reduce moisture content and increase temperature and is then supplied to the enclosure. The desiccant wheel is regenerated by the use of a second ambient airstream which is first heated with the condenser coil of the refrigerant system and then passed through the regeneration segment of the desiccant wheel. A bypass plenum is provided in the apparatus that selectively allows a third ambient airstream to be cooled in the plenum independent of the evaporator coil and desiccant wheel in the first plenum. That airstream is then supplied with the air treated in the first plenum to the enclosure.

12 Claims, 4 Drawing Sheets

HUMIDITY CONTROL UNIT AND METHOD HAVING BYPASS FOR PROCESS AIR

BACKGROUND OF THE INVENTION

The present invention relates to air conditioning and dehumidification equipment and methods, and more particularly to an air conditioning method and apparatus using desiccant wheel technology to control humidity while providing increased air flow capacity.

FIELD OF THE INVENTION

It is well known that traditional air conditioning designs are not well adapted to handle both the moisture load and the temperature loads of a building space. Typically, the major source of moisture load in a building space comes from the need to supply external make-up air to the space since that air usually has a higher moisture content than required in the building. In conventional air conditioning systems, the cooling capacity of the air conditioning unit therefore is sized to accommodate the latent (humidity) and sensible (temperature) conditions at peak temperature design conditions. When adequate cooling demands exist, appropriate dehumidification capacity is achieved. However, the humidity load on an enclosed space does not vary directly with the temperature load. That is, during morning and night times, the absolute humidity outdoors is nearly the same as during higher temperature midday periods. Thus, at those times there often is no need for cooling in the space and therefore no dehumidification takes place. Accordingly, preexisting air conditioning systems are poorly designed for those conditions. Those conditions, at times, lead to uncomfortable conditions within the building and can result in the formation of mold or the generation of other microbes within the building and its duct work. On the other hand there are periods of time, or geographic areas, where the moisture content of the air requires less dehumidification while still requiring the same or more air flow capacity.

A number of prior art devices have been suggested, using desiccant cooling systems, to solve these problems. In these devices supply air from the atmosphere is first dehumidified using a desiccant wheel or the like and the air is then cooled using a heat exchanger. The heat from this air is typically transferred to a regeneration air stream and is used to provide a portion of the desiccant regeneration power requirements. The make-up air is delivered to the space directly, as is, or alternatively is cooled either by direct evaporative means or through more traditional refrigerant-type air conditioning equipment. The desiccant wheel is regenerated with a second air stream which originates either from the enclosure being air conditioned or from the outside air. Desiccant cooling systems of this type can be designed to provide very close and independent control of humidity and temperature, but they are typically more expensive to install than traditional systems.

U.S. Pat. No. 3,401,530 to Meckler, U.S. Pat. No. 5,551,245 to Carlton, and U.S. Pat. No. 5,761,923 to Maeda disclose other hybrid devices wherein air is first cooled via a refrigerant system and dried with a desiccant. However, in all of these disclosures high regeneration temperatures are required to adequately regenerate the desiccant. In order to achieve these high temperatures, dual refrigerant circuits are needed to increase or pump up the regeneration temperature to above 140° F. In the case of the Meckler patent, waste heat from an engine is used rather than condenser heat.

Better solutions have been suggested in U.S. Pat. Nos. 6,557,365; 6,711,907 and 7,047,751 which utilize only ambient air for supply air to the enclosure and only ambient air to regenerate the desiccant. Such systems can take outside air of humid conditions, such as are typical in the South and Southeastern portions of the United States and in Asian countries and render it to a space neutral condition. Those systems have significant advantages over alternative techniques for producing air at indoor air comfort zone conditions from outside air. The most significant advantage is low energy consumption. That is, the energy required to treat the air with a desiccant assist is less than that used in previously disclosed cooling technologies.

However, such systems have air flow capacity limitations based on the size of the desiccant wheels used. Thus in some circumstances where additional air flow capacity is required multiple units may be needed to meet capacity requirements. In climate conditions where the air is dry, such units, depending on the surrounding climate, may provide warmer and drier air than needed. The present invention allows, in such conditions, the supply of larger volumes of conditioned air at the desired temperature and humidity.

OBJECTS OF THE INVENTION

It is an object of the present invention to treat outside supply air and condition it to required needs in greater air flow capacity without the need for additional or larger desiccant wheels and therefore, in an efficient and economic manner.

Yet another object of the present invention is to provide a higher air flow capacity desiccant based dehumidification and air conditioning system which is relatively inexpensive to manufacture and to operate.

A further object of the present invention is to provide an air conditioning system which enables the operator to vary the proportioning of desiccant treated supply air with additional volume of cooled outside air that does not require further drying.

In accordance with an aspect of the invention an air conditioning and dehumidification system and method utilizes multiple air plenums in or with a housing that has first and second plenums separated by an intermediate wall. The first plenum is used to supply and treat an ambient air stream and then supply that treated air to an enclosure or other area to be cooled or treated. The system also includes a liquid vapor refrigeration circuit which contains an evaporator located in the first plenum to cool and dehumidify ambient air entering the first plenum and a condenser coil in the second plenum.

A supply fan is associated with the first plenum to draw ambient air into the plenum and supply the treated air from the plenum to the enclosure, area or space. A condenser fan is associated with the second plenum to draw another ambient air stream into the second plenum which then passes through the condenser and is heated.

A desiccant dehumidification system is included in the system which utilizes a rotatably mounted desiccant wheel mounted to extend transversely to and through the intermediate wall so that a segment of the wheel is present in the first, process air, plenum and another segment is present in the second plenum, downstream of the condenser to receive air heated in the condenser as regeneration air to regenerate the desiccant wheel as it rotates during operation and after which the regeneration air is exhausted to the atmosphere.

A third ambient air plenum is also provided as an ambient air by-pass through which ambient air is selectively supplied to the enclosure or space as capacity needs are required without treatment in the first plenum by the desiccant wheel. The third plenum contains a device for cooling the ambient air drawn into the third plenum by a fan or the like before supplying that cooled third ambient airstream to the enclosure. The cooling device may be a cooler coil from a water chiller system or an evaporator coil from a DX refrigeration system that is independent from the DX system used with the first and second plenums.

In another aspect of the invention conditioned air is supplied to an enclosure or space by cooling a first ambient supply air stream with the evaporator cooling coil of a DX refrigeration system and then passing the thus cooled and dehumidified first air stream through the process segment of a rotating desiccant wheel to further reduce moisture content in the first ambient air stream. Thereafter this treated first ambient air stream is supplied to the enclosure.

The desiccant wheel is regenerated by a second ambient air stream supplied to the second plenum which first passes through the DX condenser coil in the second plenum where its temperature is raised before passing through the desiccant wheel segment in the second plenum to regenerate the wheel. After passing through the wheel the second ambient air stream is exhausted to the atmosphere.

In addition, a third ambient air stream is selectively supplied to a third plenum preferably by a fan that is preferably independent from those fans associated with the first and second plenums. This third air stream is selectively cooled by a DX system that is independent from the cooling system used in the first and second plenums, before being supplied to the enclosure without treatment by the desiccant wheel. Alternatively, instead of having a fan in the third air stream, a damper may be placed between the third ambient air stream and the first airstream, downstream of the desiccant wheel, with a fan located in the first airstream also downstream of the desiccant wheel so that the fan or fans in the first airstream pull the total volume of air from the first and third plenums through the system.

In this way by varying the supply volume and/or temperature of cool ambient air from the third plenum, the user can increase the volume of ambient air supplied to the enclosure to better and more efficiently control the temperature and humidity of the air delivered to the enclosure when ambient temperature and humidity conditions are such that dehumidification of all the ambient air at the higher air volumes required by the operator is not necessary.

BRIEF DESCRIPTION OF DRAWINGS

The above, and other objects, features and advantages of the present invention will be apparent in the following detailed description of illustrative embodiments thereof, which is to be read in connection with accompanying drawings, wherein.

DETAILED DESCRIPTION

Figure 1:
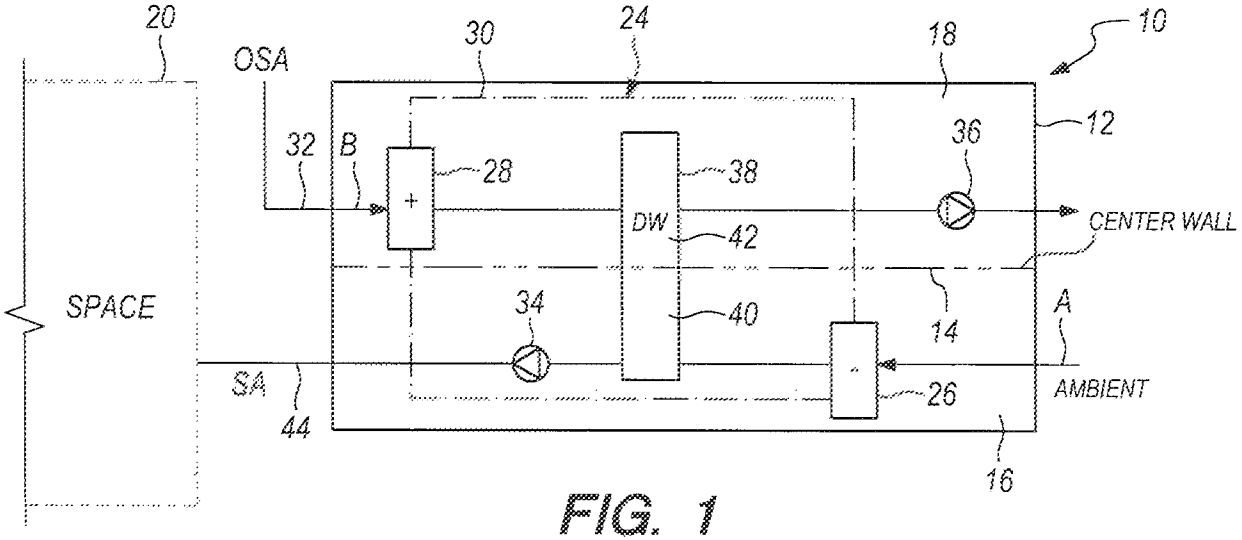
FIG. 1 PRIOR ART
FIG. 1 is a schematic top plan view of a prior art air conditioning and humidity control unit.
Figure 2:
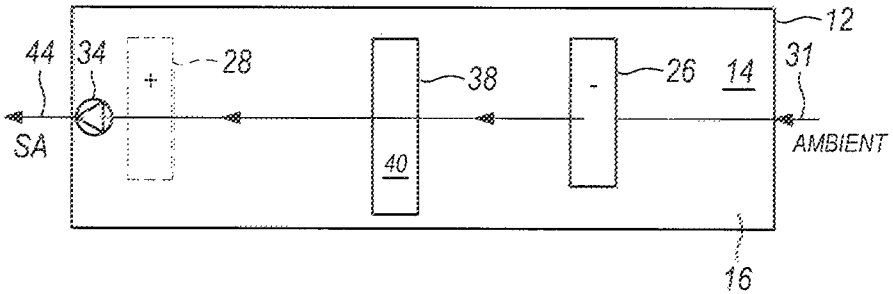
FIG. 2 PRIOR ART
FIG. 2 is a schematic side view of the prior art unit shown in FIG. 1.

Referring now to the drawings in detail, and initially to FIGS. 1 and 2, a prior art air conditioning unit 10 is illustrated of the type generally disclosed in U.S. Pat. Nos. 6,557,365, 6,711,907 and 7,047,751. The unit 10 includes a housing 12 having a separator wall 14, generally centrally located and dividing the housing into separate air plenums, namely a first plenum 16 and a second plenum 18. The unit is intended to use essentially only outside ambient air to supply conditioned dehumidified air at appropriate or desired temperature and humidity conditions to an enclosure or space 20.

The prior art air conditioning unit of FIG. 1 also includes an associated direct liquid vapor compressing expansion refrigeration system (DX) 24. The DX system 24 includes an evaporator or cooling coil 26 and a condenser coil 28, as well as a conventional compressor and expansion valve, not shown, connected by liquid vapor piping 30 shown in dashed and dotted lines.

As illustrated in FIGS. 1 and 2 the evaporator coil 26 is located in the first plenum 16 adjacent an ambient air inlet 31 in housing 12. The condenser coil 28 is located in plenum 18 adjacent another ambient air inlet 32 in housing 12. Fans 34 and 36 are provided in or connected to plenums 16 and 18 to draw ambient air into the respective plenums.

The housing 12 also contains a conventional rotatable desiccant wheel 38 which is rotatably mounted in housing 12 transverse to wall 14 and extending partly through the wall so that a segment (about half) of the wheel is exposed to the ambient air streams in plenums 16, 18, during rotation of the wheel when the unit is in operation. These segments are designated 40 in the first plenum 16 (also called the process segment for the process air) and 42 in the second plenum 18 (also called the regeneration segment for the regeneration air stream).

In operation the unit of the prior art continuously supplies conditioned outside air to the enclosure. Waste air from the enclosure is exhausted in any convenient manner by fans or the like (not shown) as is known in the art. The first ambient or process air stream A is drawn by fan 34 into plenum 16 where it is cooled and dehumidified by the evaporator coil 26. The air stream A is then further dehumidified by desiccant wheel 38 in segment 40. Appropriate controls are used for the DX system 24 and to vary the speed of rotation of the wheel 38 so that the air leaving plenum 16, through an opening 44 in housing 12, has the desired temperature and humidity conditions for the space 20.

In this system ambient or outside air is also used to regenerate the desiccant wheel. That outside air, drawn in by fan 36, passes through condenser coil 28 to increase the temperature of the second ambient air stream B. This heated airstream is then passed through the regenerating section 42 of desiccant wheel 38 to remove moisture from the wheel. The second or regeneration air stream is then exhausted to the atmosphere. This prior art system may also have means to provide some or all of the air from the enclosure to the ambient air stream A for treatment in plenum 16.

Air conditioning units of the prior art as thus described have been very efficient and successful in use. However, under certain climate conditions or for certain facilities the user requires greater air flow volumes than can be treated by one unit to condition the space involved while requiring less dehumidification of the air to achieve the desired humidity condition for the volume of air to be supplied to the enclosure or space. To satisfy that need it is typically required to use two or more such units which increases the expense for the user or produces more dehumidification than is required for the space involved.

However, it has been found that climate conditions in certain areas may be such that adequate dehumidification for the air supply to the enclosure can be achieved with a single unit and dehumidification wheel.

These issues have been resolved by the present invention which utilizes a separate third ambient air stream with no, or some, additional cooling and dehumidification, depending on the requirements of the user and the ambient conditions, that does not need additional dehumidification on the desiccant wheel.

Figure 3:
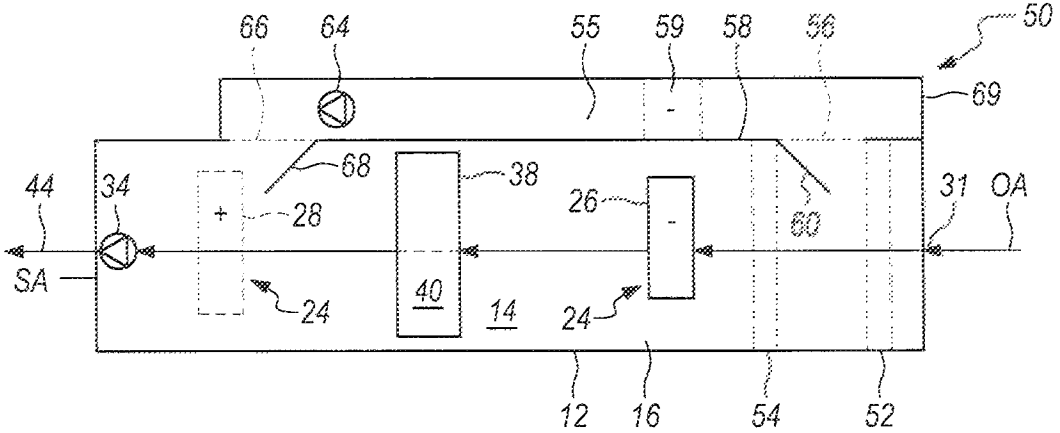
FIG. 3 is a schematic side view of an air conditioning and humidity control unit according to the present invention.
Figure 4:
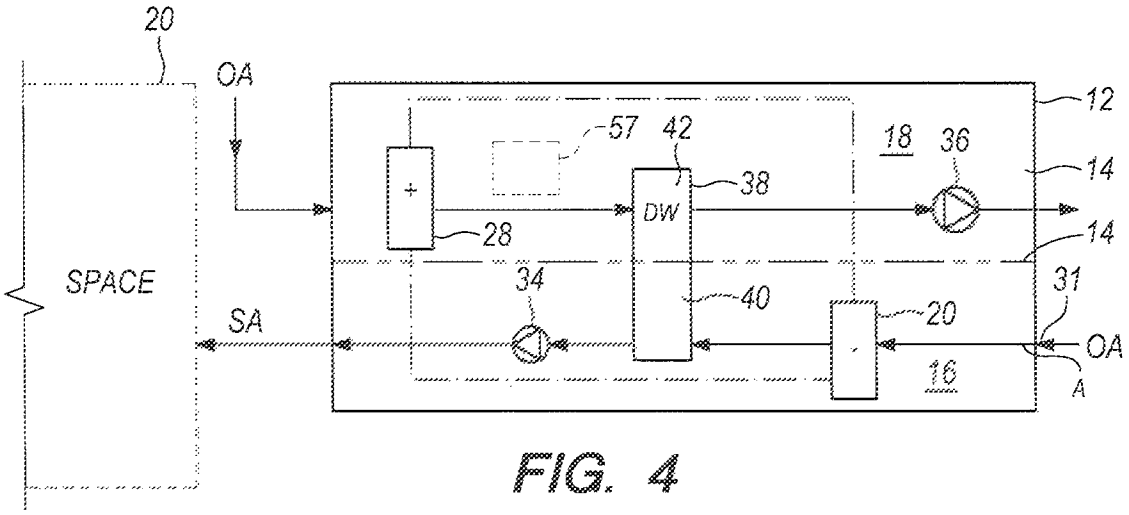
FIG. 4 is a top plan view of the view of the embodiment of FIG. 3 with the by-pass plenum removed for clarity.

FIGS. 3 and 4 illustrate additional embodiments of an air conditioning and dehumidification unit 50 according to the present invention. In these figures the reference numbers used in FIGS. 1 and 2 are used for the corresponding components in this embodiment.

As in the prior art, unit 50 shown in FIG. 3 has first and second air plenums 16, 18 (not seen in FIG. 3) separated by a central wall 14. Ambient air constituting the process or supply airstream OA enters housing 12 at opening 31 under the influence of a fan 34. As illustrated in FIG. 3, the airstream may be first passed through a conventional air filter 52 and then through a water chiller 54 for preliminary cooling, if necessary or desired. Alternatively, there can also be a condensing coil of a separate DX system (not shown) downstream of opening 31 and before cooling coil 26 that will give off heat to the ambient air when conditions warrant that. In another alternative embodiment there can also be a separate DX cooling coil for preliminary cooling where the condensing coil in the system gives off heat to the ambient air when conditions warrant that.

From the chiller 54 the air is treated in the DX system evaporator coil 26 where it is dried and cooled and then passed through the process air segment 40 of desiccant wheel 38 in which it is further dried. From there it is supplied to the enclosure or space 20.

The second ambient air stream is drawn into plenum 18 on the opposite side of wall 14 from plenum 16 by fan 36, (FIG. 4). It is first passed through condenser coil 28 of the DX system to be heated and, as before, then passed through the regeneration section 42 of desiccant wheel 38 to regenerate the wheel; it is then exhausted to the atmosphere.

A third air plenum 55 (FIG. 3) is provided to supply a volume of cooled ambient air to the enclosure without passage through the desiccant wheel. This plenum is provided in any convenient manner and is illustrated as a duct that is mounted on or formed as part of the housing 12, above the top 58 of plenums 16 and 18. However it will be understood that it can be associated with the system in any convenient manner.

As also seen in FIG. 3, the third air plenum 55 can communicate with the first air plenum 16 through passage 56 in the top wall 58 of housing 12. The passage 56 is opened or closed by a damper 60 of any convenient or known construction so that when the damper is opened, or partially opened, some of the ambient air drawn into plenum 16 is also drawn into plenum 55 by a third plenum fan 64. The damper 60 is controlled by any known control system to open or close the damper or hold it in partly opened positions to control the amount of air entering the third plenum.

The third air stream in plenum 55 may selectively be cooled as required by the evaporator coil 59 of a DX refrigeration system that is independent of the DX system 24 used in the first and second plenums or by a separate water-chilled cooler.

The cooled third airstream bypasses the desiccant wheel in housing 12 and is returned to the first or process airstream in plenum 16 downstream of the desiccant wheel through another passageway or opening 66 under the control of a damper 68. The damper 68 is opened and closed by a control system as would be understood by those skilled in the art.

In another alternative embodiment, the fan 64 can be eliminated and the fan 34 used alone to draw outside air into plenum 16 and thence a portion of it into plenum 55 through passage 56 before passing through the evaporator 26. In both embodiments, the first and third airstreams mix and are supplied together to the enclosure. Where conditions warrant, sufficient air is dried in the first plenum to reduce the humidity and temperature of a part of the required volume of supply air, while a portion of ambient air is simply cooled (and partly dried when an evaporator coil 59 is used), so that when the two airstreams mix the result has the desired overall temperature and humidity conditions needed in the enclosure. In this embodiment, instead of using the damper 60 to control air flow, the fan 64 could be provided as a modulating fan that can vary the outside air flow through plenum 55 from passage 56 or, as described below, through an ambient air inlet in end wall 69.

It is to be understood, that in lieu of the passage 56 and damper 60 described above, the third plenum can be constructed so that an ambient air inlet is provided in its end wall 69 which can be opened and closed by a damper similar to damper 60 described above.

Figure 3A:
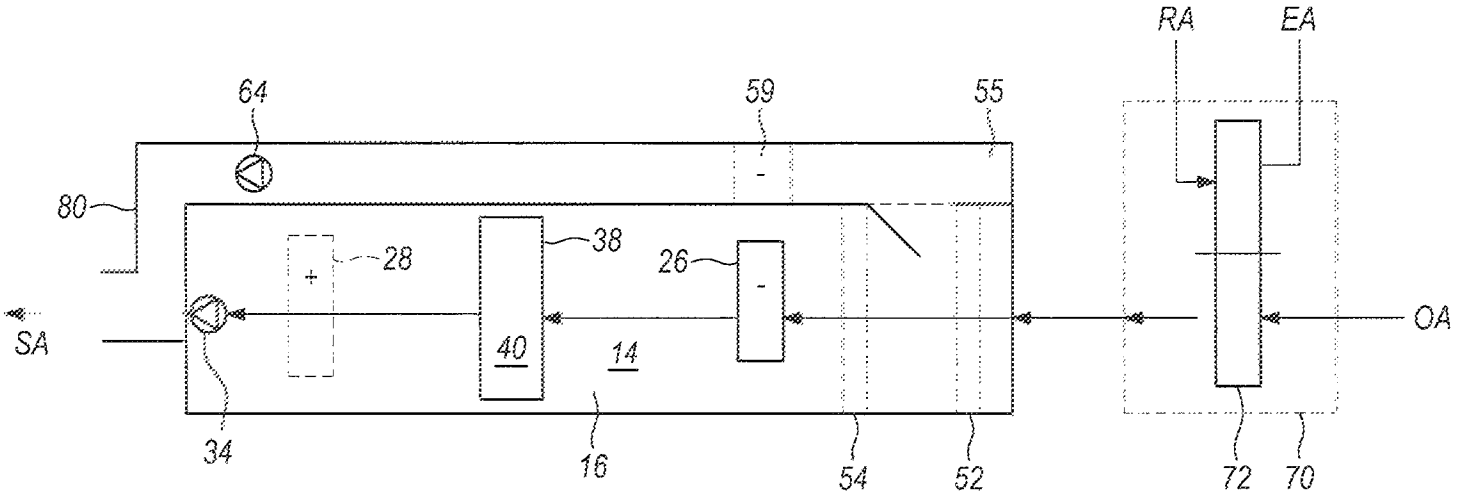
FIG. 3A is a schematic side view of another embodiment of an air conditioning and humidity control unit according to the present invention including an optional pre-treatment device.

FIG. 3A illustrates alternative embodiments of the invention in which a pretreatment unit 70 is provided to cool the ambient airstream before it enters the first plenum. This pre-treatment unit may be a heat exchanger of any known type including, for example, an enthalpy wheel 72.

As illustrated, the ambient air stream enters the enthalpy wheel 72 and is cooled before entering the evaporator 26. The enthalpy wheel is regenerated by return air removed from the enclosure by a separate ducting system and then exhausted to the atmosphere.

FIG. 3A also illustrates that rather than mixing the bypass air in the first plenum, the third plenum can be extended at its discharge end 80 to supply the bypass air directly to the enclosure.

Figure 4A:
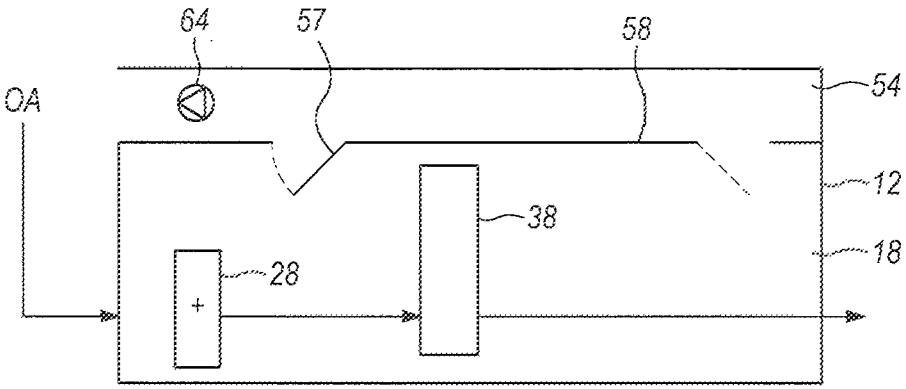
FIG. 4A is schematic side view of the plenum 18 shown in FIG. 4, including the by pass plenum.
Figure 4B:
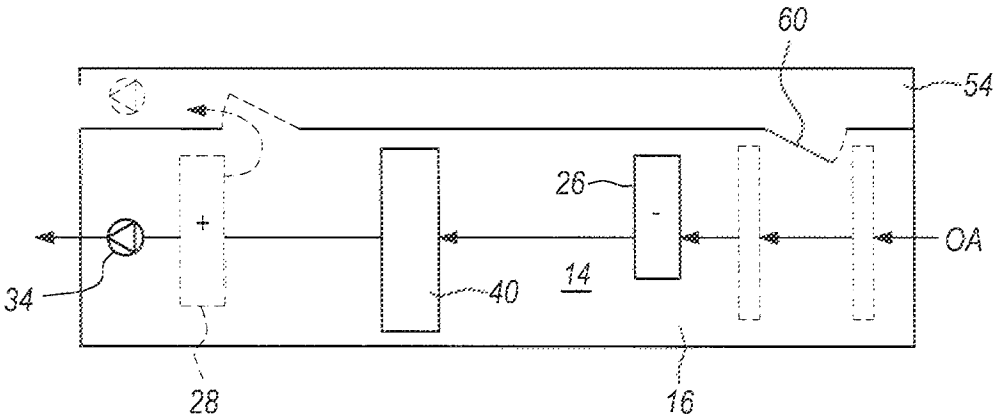
FIG. 4B is a schematic side view of the plenum 16 shown in FIG. 4, including the by pass plenum.

FIGS. 4A and 4B illustrate another embodiment of the invention which is adapted to direct a portion of the heated air in plenum 18 leaving condenser 28 into the third plenum 55. This is accomplished by the use of a selectively operable damper 57 which allows some of the heated air from the condenser 28 to enter plenum 55 to heat or replace the ambient air normally in that plenum. The damper 57 would typically be operated when the outside air temperature is at or below the temperature the bypass air is designed to provide.

Although illustrative embodiments of the present invention have been described herein with reference to the accompanying drawings, it is to be understood that the invention is not limited to those precise embodiments, but that various changes and modifications can be affected therein by those skilled in the art without departing from the scope or spirit of this invention.

What is claimed is:

1. An air conditioning and dehumidification system comprising:

an enclosed housing having a dividing wall dividing the housing into first and second air plenums;

a refrigeration circuit including an evaporator coil in the first plenum, a condenser coil in the second plenum, and a condenser fan for drawing ambient air into the second plenum and through the condenser and discharging the air downstream from the condenser and to the outside of the housing;

a dehumidification system in the housing including a desiccant wheel rotatably mounted in the housing to rotate in a plane perpendicular to the dividing wall whereby one segment of the wheel functioning as the process segment is located in the first plenum and a second segment of the wheel functioning as the regeneration segment is located in the second plenum;

an ambient air supply air fan for drawing ambient air into the first plenum through the evaporator and then through the process segment of the desiccant wheel whereby the ambient air in the first plenum is cooled and dehumidified and supplied from the first plenum to an enclosure;

an ambient air bypass defining a third plenum and means for supplying ambient air through the third plenum and selectively to the enclosure as a bypass airstream; and means for selectively cooling the bypass airstream in the third plenum, wherein the means for selectively cooling the bypass airstream is a chilled water coil.

2. The system as defined in claim 1, wherein the means for selectively supplying ambient air through the third plenum includes a bypass fan drawing air from the atmosphere through the means for selectively cooling the bypass airstream and then to the enclosure.

3. The system as defined in claim 1, wherein the third plenum includes means for selectively supplying ambient air from the first plenum, before it is cooled in the evaporator of the first plenum, to the third plenum.

4. The system as defined in claim 3, wherein the means for selectively supplying ambient air to the third plenum includes a selectively operable means for directing ambient air from the first plenum upstream of the evaporator in the first plenum.

5. The system as defined in claim 4, further comprising means downstream of the cooling means in the third plenum for blending cooled air having passed through the cooling means in the third plenum with air leaving the desiccant wheel in the first chamber before being supplied to the enclosure.

6. The system as defined in claim 1, further comprising means for dividing a portion of the air leaving the condenser in the second plenum into the third plenum.

7. The system as defined in claim 1, further comprising heat exchanger means upstream of the evaporator in the first plenum for precooling ambient air before being further cooled in the evaporator in the first plenum or supplied to the third plenum.

8. A method for conditioning ambient air for supply to an enclosure, comprising the steps of:

cooling a first ambient supply airstream with a cooling coil of a refrigerant system, then passing the cooled ambient supply airstream through a segment of a rotating desiccant wheel to reduce the moisture content of the ambient airstream, and passing the thus treated air to the enclosure;

regenerating the desiccant wheel by heating a second ambient airstream with a condensing coil of the refrigerant system and passing the heated second ambient airstream through a regeneration segment of the desiccant wheel; and selectively cooling a supply of ambient air in a bypass plenum with a chilled water coil, without treatment in the first plenum, and supplying the cooled air from the bypass plenum to the enclosure.

9. The method as defined in claim 8, wherein the ambient air in the bypass plenum is a third ambient airstream independent of the airstreams in the first and second plenums.

10. The method as defined in claim 8, wherein the ambient air in the bypass plenum is supplied from the ambient air in the first plenum upstream of the evaporator coil in the first plenum.

11. The method as defined in claim 9, wherein the ambient air in the third plenum is supplied to the first plenum downstream of the desiccant wheel and mixed with the air leaving the process segment of the wheel before being supplied to the enclosure.

12. The method as defined in claim 8, further comprising the step of pretreating ambient air supplied to the first plenum.

* * * * *